United States Patent [19]

Ueda

[11] Patent Number: 4,498,453

[45] Date of Patent: Feb. 12, 1985

[54] COOKING APPLIANCE

[75] Inventor: Katsuroh Ueda, Yamatokoriyama, Japan

[73] Assignee: Matsushita Electric Industrial Co., Ltd., Kadoma, Japan

[21] Appl. No.: 522,363

[22] PCT Filed: Nov. 24, 1982

[86] PCT No.: PCT/JP82/00448

§ 371 Date: Jul. 22, 1983

§ 102(e) Date: Jul. 22, 1983

[87] PCT Pub. No.: WO83/01991

PCT Pub. Date: Jun. 9, 1983

[30] Foreign Application Priority Data

Nov. 25, 1981 [JP] Japan ..... 56-189741

[51] Int. Cl.[3] ..... F24C 15/16

[52] U.S. Cl. ..... 126/21 A; 219/10.55 R

[58] Field of Search ..... 126/21 A, 273 R, 273 A; 219/10.55 R

[56] References Cited

U.S. PATENT DOCUMENTS

| | | | |
|---|---|---|---|
| 3,698,377 | 10/1972 | Smith | 126/21 A |
| 3,710,775 | 1/1973 | Tamada | 126/21 A |
| 3,812,837 | 5/1974 | Takase | 126/21 A |
| 3,926,106 | 12/1975 | Deusing | 126/21 A |
| 4,108,139 | 8/1978 | Gilliom | 126/21 A |
| 4,336,789 | 6/1982 | Ogawa | 126/21 A |
| 4,373,504 | 2/1983 | Day | 126/21 A |
| 4,392,038 | 7/1983 | Day | 126/21 A |
| 4,395,233 | 7/1983 | Smith | 126/21 A |
| 4,430,541 | 2/1984 | Day | 219/10.55 R |
| 4,430,989 | 2/1984 | Narang | 126/21 A |
| 4,431,889 | 2/1984 | Saponara | 126/21 A |

*Primary Examiner*—Larry Jones

*Attorney, Agent, or Firm*—Wenderoth, Lind & Ponack

[57] ABSTRACT

A conventional gas oven having exhaust holes in the high air pressure region of a heating chamber has a drawback that when a circulation fan is rotating, hot air is constantly discharged to cause a great heat loss. According to the present invention, exhaust holes are provided in or adjacent a region where the pressure becomes negative owing to the suction of a circulation fan when the gas combustion is off, with the result that there is no possibility of hot air being unnecessarily discharged in the gas combustion-off period and that in the gas combustion-on period the amount of discharge is automatically controlled according to the combustion rate. Thus, the invention is characterized by quick temperature rise and the saving of energy, consuming less fuel.

3 Claims, 13 Drawing Figures

COOKING APPLIANCE

BACKGROUND OF THE INVENTION

1. Field of the Invention

The present invention relates to a cooking appliance of the so-called forced hot air circulation type wherein hot air heated by a heat source is fed into a heating chamber and the temperature distribution in the heating chamber is kept uniform by a circulation fan.

2. Description of the Prior Art

This type of cooking appliance includes an electric oven using an electric heater as a heat source, a gas oven using gas combustion as a heat source, and a composite cooking appliance comprising a microwave oven combined with such an oven.

While the demand for energy conservation has been gaining momentum these years, the gas oven suffers a great heat loss involved in exhaust peculiar to gas combustion, being inferior in thermal efficiency to the electric oven. Further, since this high temperature exhaust is discharged outside the appliance, severe restrictions are imposed on the gas oven relative to its surroundings from the standpoint of fire prevention.

In such circumstances, examples of gas ovens on the market will now be described with reference to FIGS. 1(*a*)-(*b*) and 2(*a*)-(*c*).

In a gas oven shown in FIG. 1, the front of a heating chamber 4 for heating a heating load 3 placed in a pan 2 is provided with a door 1. Disposed under the heating chamber 4, there are a burner 5 for gas combustion as a heat source and a combustion chamber 6 having a sufficient space for gas combustion. Disposed in the rear of the heating chamber 4, there is an air blast chamber 8 having a circulation fan 7 installed therein to feed hot air heated in the combustion chamber 6 and to keep uniform the temperature distribution in the heating chamber 4. In the rear of the air blast chamber 8, there is a combustion passage chamber 6' communicating with the combustion chamber 6 to introduce the hot air into the air blast chamber 8.

The circulation fan 7 is in the form of a disk having vanes 10 and 13 mounted thereon and is driven for rotation by a motor 9. The vanes 10 serve to draw the hot air, which has been introduced into the combustion passage chamber 6' from the combustion chamber 6, into the air blast chamber 8 through a suction port 11 and then deliver it into the heating chamber 4 through blast holes 12. Meanwhile the vanes 13 serve to draw the hot air into the air blast chamber 8 from the heating chamber 4 through vent holes 14 and then deliver it again into the heating chamber 4 through the blast holes 12.

The air supply and exhaust system necessary for gas combustion comprise air supply holes 16 for supplying air necessary for gas combustion effected by the burner 5 in the combustion chamber 6, and exhaust holes 15 formed in the upper region of the rear wall of the heating chamber 4; thus, the hot air forced out through the exhaust holes 15 passes through an exhaust passage 17 and then through a ceiling exhaust holes 18 for discharge from the outside.

Further, this gas oven is designed so that when the temperature in the heating chamber 4 reaches a preset value, the supply of gas to the burner is rendered intermittent to keep the temperature in the heating chamber 4 substantially constant, but the circulation fan 7 is allowed to continue rotating to ensure that the temperature distribution in the heating chamber 4 is uniform.

The conventional gas oven of FIG. 1 constructed in the manner described above feeds a substantially constant amount of air at all times into the heating chamber 4 from the combustion chamber 6 through the air blast chamber 8 by means of the rotation of the fan 7, so that it follows that the air pressure in the heating chamber 4 increases and that a substantially constant amount of exhaust is discharged through the upper exhaust holes 15.

Therefore, even when the burner 5 is in the combustion-off state during its intermittent or on-off operation started after the temperature in the heating chamber 4 has reached a predetermined value, the same amount of exhaust as that with the burner 5 in the combustion-on state is discharged; thus, discharge of exhaust, which is not necessary when the burner 5 is in the combustion-off state, is forced to take place, resulting in a great heat loss. This heat loss occurs because the circulation fan 7 is separately provided with the vanes 10 for drawing hot air from the combustion chamber 6 and the vanes 13 for circulating the hot air in the combustion chamber 4 and that the exhaust holes 15 are provided in the heating chamber 4 whose air pressure is always higher than the atmospheric pressure.

The gas oven shown in FIG. 2 has a construction in which the circulation fan 7 of the gas oven shown in FIG. 1 is improved. The combustion chamber 6 is located between the heating chamber 4 and the air blast chamber 8. The function of drawing the hot air heated in the combustion chamber 6 into the air blast chamber 8 through the suction port 11 and delivering it to the heating chamber 4 through the blast holes 12, and the function of drawing the hot air into the air blast chamber 8 from the heating chamber 4 successively through the vent holes 14, combustion chamber 6 and suction port 11 and delivering it to the heating chamber 4 through the blast holes 12 are performed by the vanes 13 alone.

Other arrangements and functions are the same as those of the gas oven shown in FIG. 1.

As a result of changing the position of the combustion chamber 6 and the arrangement of the circulation fan 7 in this manner, when the burner 5 is in the combustion-off state during its on-off operation after the temperature in the heating chamber 4 has reached a preset value, the combustion chamber 6 is substantially filled with the hot air fed thereto from the heating chamber 4 through the vent holes 14 and said hot air is drawn into the air blast chamber 8 through the suction port 11, so that the amount of cool air newly drawn through air feed holes 16 is relatively small and hence the amount of exhaust discharged through the exhaust holes 15 in the upper region of the heating chamber 4 correspondingly decreases. In the combustion-on period, since the combustion chamber 6 is substantially filled with combustion gas produced by combustion at the burner 5, the amount fed into the combustion chamber 6 from the heating chamber 4 decreases and hence the amount discharged through the exhaust holes 15 correspondingly increases. However, since the air pressure in the heating chamber 4 is substantially high even during the combustion-off period, the drawbacks that a substantial amount of exhaust is forced to take place and that the heat loss involved in exhaust is great, remain to be eliminated also in this conventional example.

SUMMARY OF INVENTION

The present invention eliminates the drawbacks inherent in the conventional examples and is intended to provide a gas oven which has a decreased heat loss involved in exhaust and an increased thermal efficiency, takes a short time to reach a preset temperature, and is featured by the saving of time and energy and by superior cooking performance.

Efforts have been made to achieve this object by providing the exhaust port with a shutter which is operatively associated with the on- and off-state of gas combustion so that the shutter will be opened in the combustion-on period to effect proper exhaust but in the combustion-off period it will be closed to avoid unnecessary exhaust so as to decrease heat loss. But such an arrangement has not come to be put into practical use because of its high cost. A cooking appliance according to the present invention comprises a heating chamber for receiving a heating load, heating means for heating the heating chamber, a circulation fan for feeding the air heated by the heating means into the heating chamber and keeping uniform the temperature distribution in the heating chamber, an air blast chamber housing the circulation fan, blast holes and air feed holes disposed between the air blast chamber and the heating chamber, and exhaust holes through which the air circulating through the heating chamber is discharged outside, wherein the exhaust holes or a region communicating with the exhaust holes is located adjacent the suction area of the air blast chamber.

In the arrangement described above, the provision of the exhaust holes in or adjacent the region where the pressure becomes negative owing to suction by the circulation fan in the gas combustion-off period ensures that unnecessary discharge of hot air does not take place in the gas combustion-off period. Further, in the gas combustion-off period, the amount of exhaust is automatically adjusted according to the combustion rate, the temperature rise is rapid and the fuel consumption is small, providing a remarkable energy-saving effect.

DETAILED DESCRIPTION OF THE PREFERRED EMBODIMENTS

An embodiment of the invention will now be described with reference to FIGS. 3 through 7.

Figure 3:
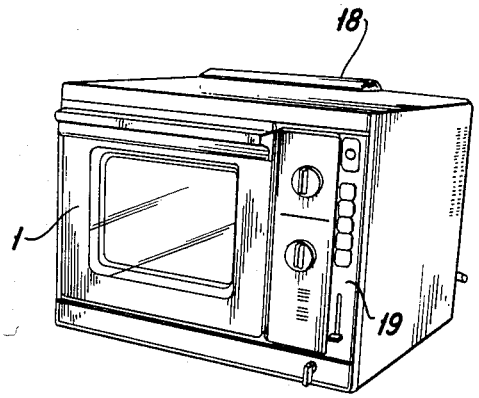
FIG. 3 is a perspective view of a cooking appliance showing an embodiment of the present invention.

FIG. 3 is a perspective view of a gas oven, wherein the front surface is provided with a door 1 which can be opened and closed for putting a heating load in and out of the heating chamber and an operating panel 19, and the rear-portion is provided with a ceiling exhaust port 18 for discharging the exhaust resulting from gas combustion.

Figure 4:
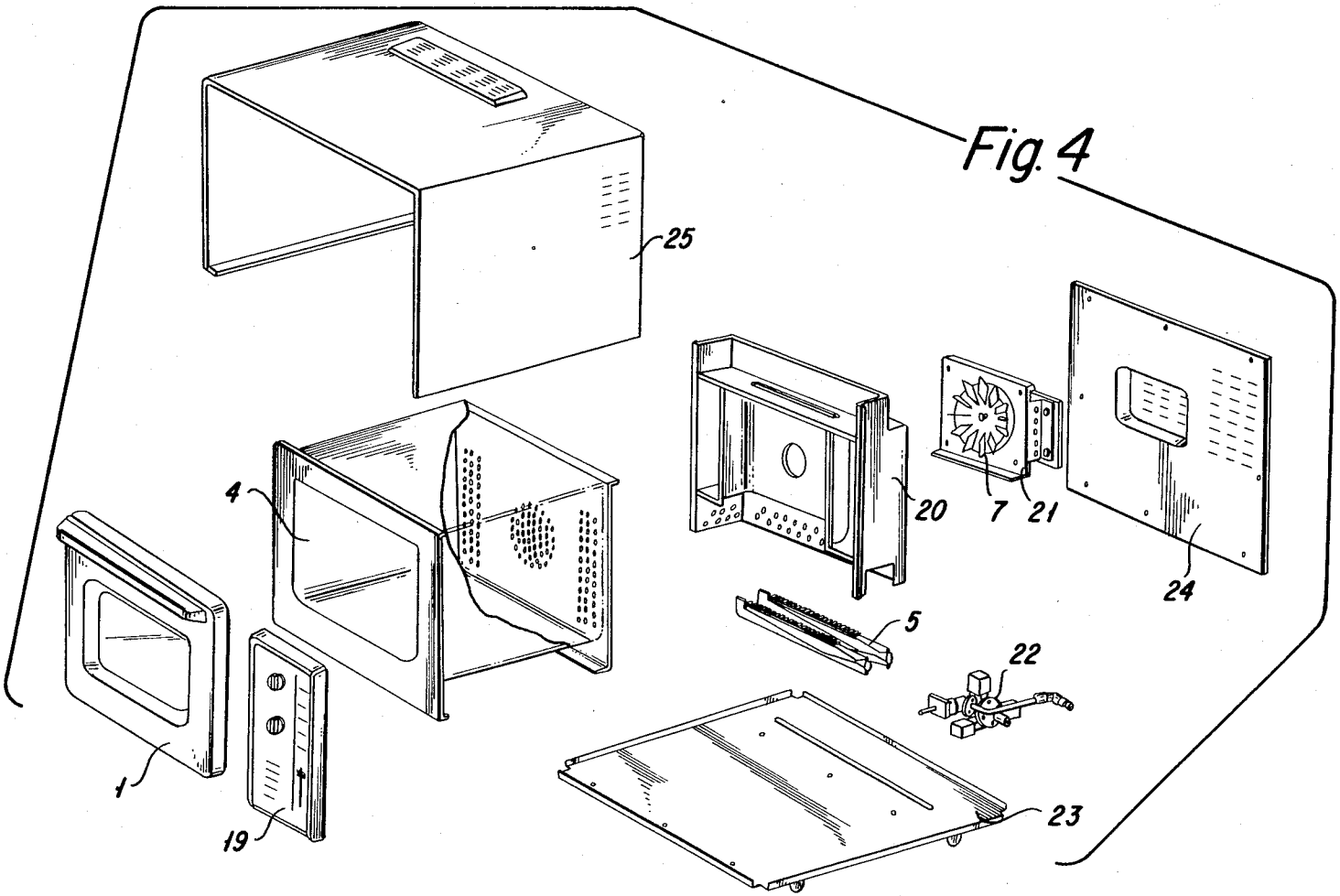
FIG. 4 is an exploded perspective view of said cooking appliance.

FIG. 4 is an exploded perspective view of said gas oven. The front of the heating chamber 4 is provided with the door 1 and the operating panel 19 and the rear is provided with a burner 5 for gas combustion, and a combustion box 20 forming a combustion chamber and an air blast chamber. The rear of said combustion box 20 is provided with a fan attaching plate 21 to which a circulation fan 7 is attached. The inlet to said burner 5 is provided with a gas block 22 which forms a gas circuit. The numerals 23, 24 and 25 denote a bottom plate, a rear plate and a ceiling plate integral with the lateral plates, these three forming the shell of the gas oven.

Figure 5:
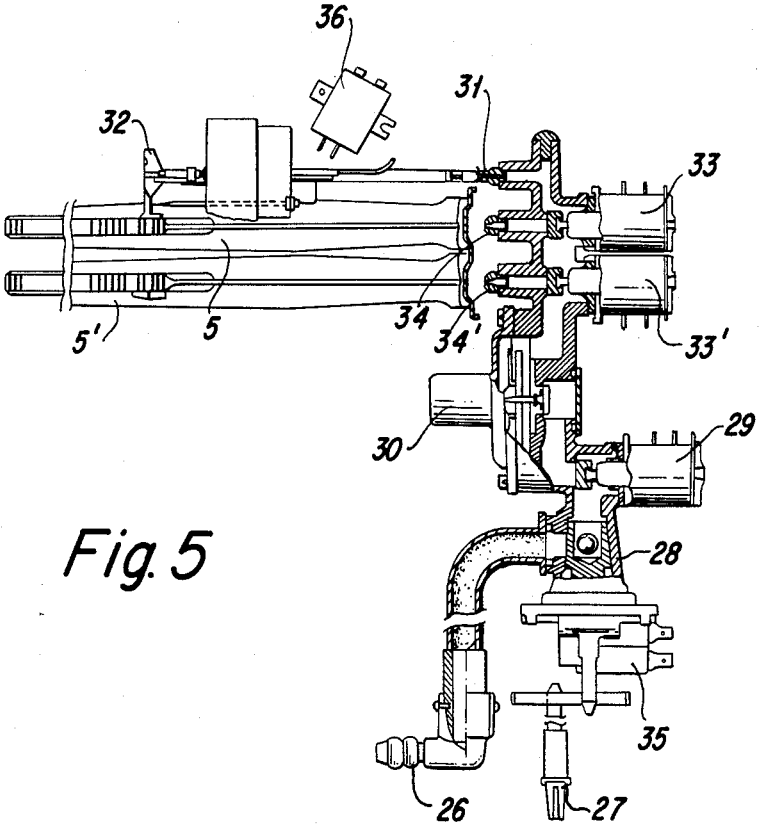
FIG. 5 is a sectional view showing the gas circuit of said cooking appliance.

FIG. 5 is a gas circuit diagram, showing the construction of the gas block. The gas enters at a gas inlet port 26 and flows successively through a cock 28 interlocked to a knob 27, a safety solenoid valve 29 and a gas pressure control unit 30, and into a pilot nozzle 31, from which it is fed to a pilot burner 32, while it is also fed to main nozzles 34 and 34' through temperature control solenoid valves 33 and 33', and then to burners 5 and 5'. The numeral 35 denotes an ignition switch, and 36 denotes an electric discharge type ignitor.

Figure 6A:
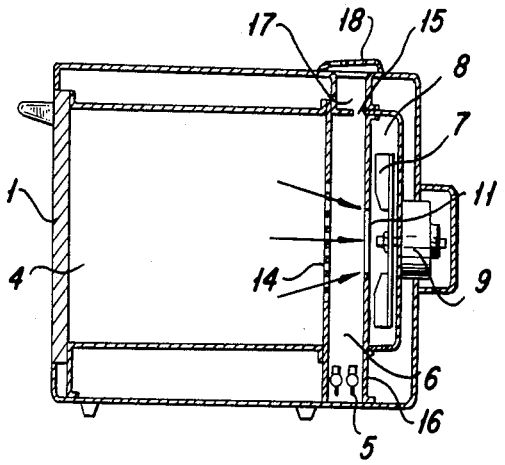
FIGS. 6(*a*), (*b*), (*c*) are a lateral sectional view and a plan sectional view of the appliance and a front view of the rear wall of the heating chamber.
Figure 6B:
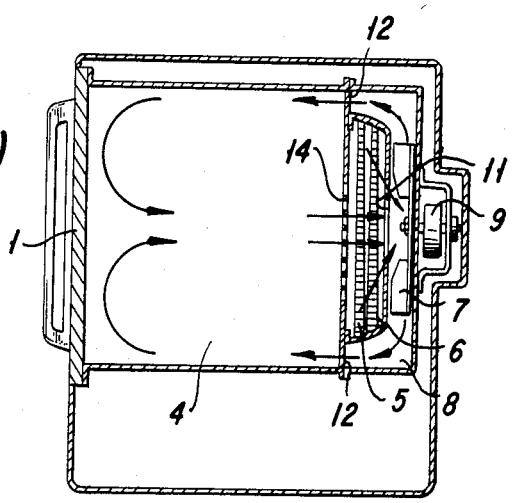
Figure 6C:
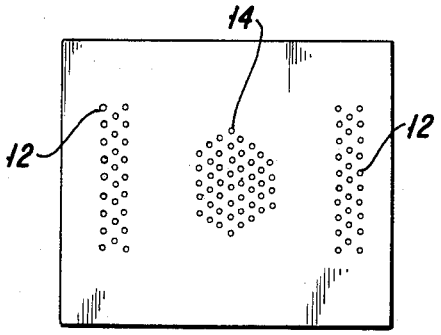

In FIGS. 6(*a*), (*b*), (*c*), the front surface of the heating chamber 4 is provided with a door 1 and the rear of the heating chamber 4 is provided with a combustion chamber 6 having a burner 5 for gas combustion disposed in the lower region and a space in the upper region necessary for gas combustion, and an air blast chamber 8 having a circulation fan 7 disposed therein.

Air feed holes 16 for feeding air necessary for gas combustion are disposed adjacent the burner 5 in said combustion chamber 6, and a boundary wall between the combustion chamber 6 and the air blast chamber 8 is formed with blast holes 12 and a boundary wall between the heating chamber 4 and the combustion chamber 6 is formed with vent holes 14. Further, the upper wall of the combustion chamber 6 is formed with an exhaust port 15, above which there is formed an exhaust passage 17 leading to ceiling exhaust holes 18.

The operation of the gas oven constructed in the manner discussed above will now be described. In FIG. 5, when the knob 27 is manipulated, the cock 28 and safety solenoid valve 29, which are interlocked thereto, are opened, and as soon as the gas is fed to the pilot burner 32 from the pilot nozzle 31, the ignition switch 35 is turned on, causing the electric discharge type ignitor 36 to ignite the pilot burner 32. The temperature control solenoid valves 33 and 33' are then opened, causing the main nozzles 34 and 34' to feed gas to the burners 5 and 5', so that the gas is ignited by the flame of the pilot burner 32 and burns.

Figure 7A:
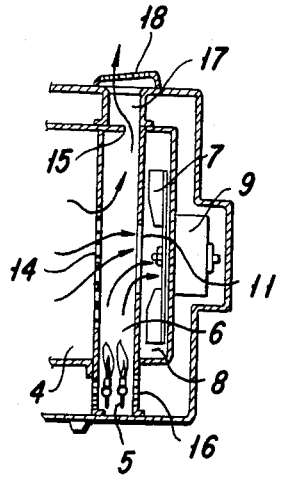
FIGS. 7(*a*), (*b*) are lateral sectional views of the principal portion, illustrating the operation of the appliance.
Figure 7B:
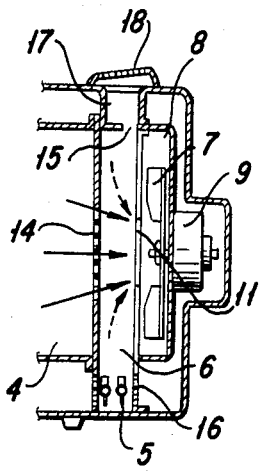

On the other hand, in FIG. 6, the circulation fan 7 starts rotating at the same time, drawing the combustion gas in the combustion chamber 6 into the air blast chamber 8 through the suction port 11 and delivering it to the heating chamber 4 through the blast holes 12. As the pressure in the heating chamber 4 builds up, the combustion gas is fed back to the combustion chamber 6 through the vent holes 14, but as shown in FIG. 7(*a*), part of the combustion gas is drawn into the air blast chamber 8 together with fresh combustion gas, while the rest is discharged outside the system through the exhaust holes 15, exhaust passage 17 and ceiling exhaust holes 18. Thus, the hot air circulating through the combustion chamber 6, air blast chamber 8 and heating chamber 4 is partly replaced by fresh combustion gas in the combustion chamber 6, progressively increasing in temperature.

After the temperature in the heating chamber 4 has reached a preset value, the temperature control solenoid valves 33 and 33' shown in FIG. 5 initiate an on-off operation, opening and closing the gas passages to the main nozzles 34 and 34', rendering the gas combustion of the burners 5 and 5' on and off so as to keep the temperature in the heating chamber 4 constant, but the circulation fan 7 continues rotating to make uniform the temperature distribution in the heating chamber 4.

FIG. 7(*b*) shows the flow of hot air when the gas combustion is off. Since there is almost no combustion gas from the burner 5, most of the hot air fed into the combustion chamber 6 from the heating chamber 4 is drawn back into the air blast chamber 8, so that a very little amount is discharged outside the system through the exhaust holes 15.

The temperature control of the gas oven in the range from the yeast fermentation temperature to 300° C. is such that at a high preset temperature of about 250° C. or above, the burner 5 in FIG. 5 burns continuously while the gas combustion of the burner 5' is rendered on and off. At a low preset temperature of about 200° C. or below the gas combustion of the burner 5' is off while the gas combustion of the burner 5 alone is rendered on and off.

In this arrangement wherein heating power is switched in two stages, the amount of gas combustion during low combustion is half the amount during high combustion, so that in FIG. 7(*a*), of the hot air fed into the combustion chamber 6 from the heating chamber 4, the portion which is drawn back into the air blast chamber 8 is correspondingly increased, whereas the portion discharged outside the system through the exhaust holes 15 is decreased. That is, the amount of exhaust discharged outside the system through the exhaust holes 15 is automatically controlled according to the gas combustion rate of the burner 5.

In addition, the size of the air feed holes 16 is such that a sufficient amount of air for gas combustion can be supplied; the size of the suction port 11 is such that the suction capacity of the circulation fan 7 can be fully developed; the size and arrangement of the blast holes 12 of FIG. 6 are such as to avoid uneven heating of the heating load in the heating chamber 4; and the size and position of the vent holes 14 are such as to avoid adversely affecting gas combustion and to ensure that in the gas combustion-off period most of the hot air fed into the combustion chamber 6 from the heating chamber 4 is drawn into the air blast chamber 8. These factors are experimentally determined. Further, the size and position of the exhaust holes 15 are also experimentally determined in relation to the maximum combustion rate.

Figure 1A:
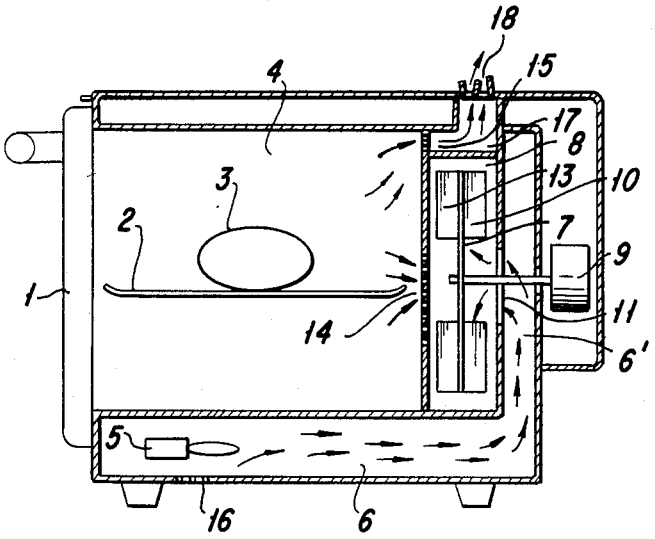
Fig. 1(a) PRIOR ART
FIGS. 1(*a*), (*b*) and 2(*a*), (*b*) are a lateral sectional view and plan sectional view of a conventional cooking appliance.
Figure 1B:
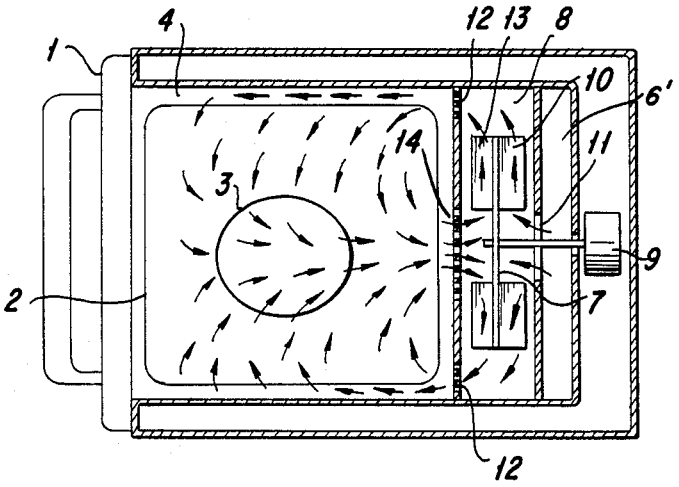
Fig. 1(b) PRIOR ART
Figure 2A:
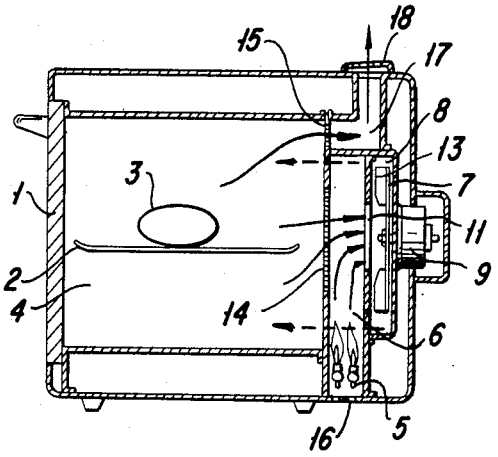
Fig.2(a) PRIOR ART
FIG. 2(*c*) is a front view of the rear wall of a conventional heating chamber.
Figure 2B:
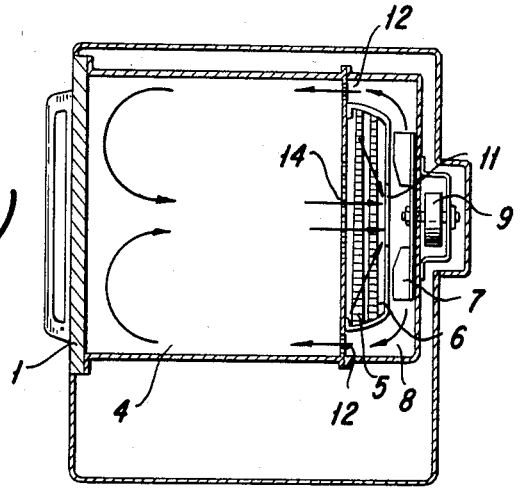
Fig.2(b) PRIOR ART
Figure 2C:
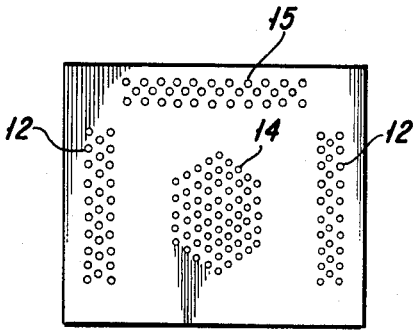
Fig.2(c) PRIOR ART

As described above, in this embodiment, in the gas combustion-off period there is almost no exhaust discharged through the exhaust holes 15 and in the gas combustion-on period the amount of exhaust is automatically controlled according to the gas combustion rate. Thus, as compared with the conventional gas oven wherein the exhaust holes 15 of FIGS. 1 and 2 are located in the higher pressure region and the discharge rate of exhaust is substantially constant, the present gas oven suffers less heat loss, being high in thermal efficiency.

The following table shows the results of experiments making a comparison between the gas oven according to this embodiment and the conventional example.

The factors measured in these comparative experiments are the gas consumption required to maintain a given temperature for a given period of time, and the time taken to reach a given temperature from the normal temperature, which are taken as substitute characteristics indicative of the thermal efficiency of the gas oven, and the rise in the temperature, about two hours later, of a wooden plate placed above the exhaust holes 15, which plate is taken as a typical example of the adverse effect of the exhaust heat on the surroundings of the appliance.

TABLE

| | Present Invention | Conventional example (first time) |
|---|---|---|
| Gas consumption required to maintain the heating chamber at 300° C. (1 hour of burning of propane gas) | 113 l | 140 l |
| Gas consumption required to maintain the heating chamber at 200° C. (1 hour of burning of propane gas) | 65 l | 105 l |
| Rise in temperature of wooden plate placed 25 cm above the ceiling exhaust holes | 56 deg | 119 deg |
| Rise in temperature of wooden plate placed 45 cm above the ceiling exhaust holes | 41 deg | 79 deg |
| Time taken for temperature in the heating chamber to rise to 200° C. from the normal temperature | 1 minute and 46 seconds | 4 minutes and 35 seconds |
| Time taken for temperature in the heating chamber to rise to 300° C. from the normal temperature | 3 minutes and 40 seconds | 9 minutes and 40 seconds |

As indicated by the experimental results, this embodiment of the invention provides the following merits.

(1) Despite the continuous rotation of the circulation fan during heating, the positioning of the exhaust holes on the suction side of the circulation fan, coupled with a more or less negative pressure present around the exhaust holes, makes it difficult for the hot air to escape through the exhaust holes, thus reducing the preheating time, namely, temperature rise time and hence the cooking time, achieving a great reduction in gas consumption.

(2) During heating, the amount of hot air discharged through the exhaust holes is small and the temperature of the exhaust section lowers to a great extent. In the conventional gas oven, the higher temperature of its exhaust tends to elevate the temperature in the kitchen in summer, making the gas oven inconvenient to use. This drawback has been greatly remedied. Further, the range of selection of a place for installation of the gas oven is widened.

(3) Since the amount of hot air discharged through the exhaust holes is small even when the burner is turned off upon attainment of a preset temperature, the temperature drop in the heating chamber during the off-period is gentle, so that particularly in the case of baking cake and the like, there is little possibility of local overheating of the surface; thus, the cooking performance is improved, providing satisfactory results.

As has been described so far, according to the present invention, since the amount of hot air discharged through the exhaust holes is small and so is the heat loss involved in exhaust, the preheating time required to reach a preset temperature, namely, the temperature rise time, is shortened, thus making it possible to provide a gas oven, an electric oven or a combination of a gas oven and microwave oven, which is characterized by the saving of time and energy and by superior cooking performance.

What is claimed is:

1. A cooking appliance comprising:

a heating chamber means for accommodating food to be heated;

a combustion chamber being positioned behind the heating chamber means and having a gas burner means provided therein for generating hot combustion air;

an air blast chamber surrounding the sides and back of the combustion chamber;

a boundary wall means for separating the heating chamber means from the combustion chamber and the air blast chamber;

said wall means having a plurality of vent hole means centrally located therein for allowing vapors from the heating chamber means to pass into the combustion chamber;

said wall means also having a plurality of blast hole means, located along the periphery thereof, for allowing combustion air mixed with the vapors to be recirculated from the combustion chamber through the air blast chamber into the heating chamber means;

a fan means, positioned in the air blast chamber behind the combustion chamber, for recirculating combustion air mixed with the vapors from the combustion chamber through the air blast chamber, through the blast hole means in the wall means, and back into the heating chamber means; and an exhaust passage means, arranged in direct communication with the combustion chamber, for creating a slight negative air pressure in the combustion chamber so that part of the combustion air mixed with the vapors is exhausted to the outside atmosphere and the rest is recirculated to the heating chamber means while the fan means is operating.

2. The cooking apparatus, according to claim 1, further comprising:

exhaust port means, positioned between the combustion chamber and the exhaust passage means, for allowing discharge of a very little amount of the combustion air mixed with the vapors from the heating chamber means to the outside atmosphere.

3. The cooking apparatus, according to claim 2, wherein:

said gas burner means is composed of two separate burners, both provided at an end of the combustion chamber opposite from the exhaust port means.

* * * * *